US010476178B2

(12) United States Patent
Hamada et al.

(10) Patent No.: US 10,476,178 B2
(45) Date of Patent: Nov. 12, 2019

(54) CABLE MOUNTING MEMBER, CABLE MOUNTING MEMBER WITH CABLE AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuaki Hamada, Mie (JP); Kenji Miyamoto, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 18 days.

(21) Appl. No.: 15/797,199

(22) Filed: Oct. 30, 2017

(65) Prior Publication Data

US 2018/0138601 A1 May 17, 2018

(30) Foreign Application Priority Data

Nov. 11, 2016 (JP) ..... 2016-220326

(51) Int. Cl.
*H01R 4/18* (2006.01)
*H01R 13/58* (2006.01)
*H01B 11/02* (2006.01)

(52) U.S. Cl.
CPC ..... *H01R 4/185* (2013.01); *H01R 13/5808* (2013.01); *H01B 11/02* (2013.01)

(58) Field of Classification Search
CPC ..... H01R 4/184; H01R 4/185; H01R 4/186; H01R 4/20
USPC ..... 439/865, 877, 745
See application file for complete search history.

(56) References Cited

U.S. PATENT DOCUMENTS 3,320,574 A * 5/1967 Tuchel ..... H01R 4/188 439/745
3,549,787 A * 12/1970 Churla, Jr. ..... H01R 4/186 174/75 C
6,059,616 A * 5/2000 Bluemmel ..... H01R 4/185 439/867
9,184,541 B2 * 11/2015 Miyamoto ..... H01R 4/206
(Continued)

FOREIGN PATENT DOCUMENTS

JP 2012-155892 8/2012

*Primary Examiner* — Hae Moon Hyeon
(74) *Attorney, Agent, or Firm* — Gerald E. Hespos; Michael J. Porco; Matthew T. Hespos

(57) ABSTRACT

A cable mounting member (30) to be mounted on a cable (21) including cores (23) and an insulation coating (24) surrounding the cores (23) includes a first holding portion (34) for holding the cable (21) by being held in contact with an outer peripheral surface of the insulation coating (24), a second holding portion (35) provided at a position different from the first holding portion (34) in a direction along an axial direction of the cable (21) via a first slit (33) for holding the cable (21) by being held in contact with the outer peripheral surface of the insulation coating (24), and deflectable and deformable first couplings (37) provided in parts between the first and second holding portions (34, 35) where the first slit (33) is absent and coupling the first and second holding portions (34, 35).

7 Claims, 26 Drawing Sheets

(56) References Cited

U.S. PATENT DOCUMENTS

| | | | | |
|---|---|---|---|---|
| 10,103,469 | B1 * | 10/2018 | Humphrey | H01R 4/185 |
| 2015/0079825 | A1 * | 3/2015 | Miyamoto | H01R 4/206<br>439/152 |

* cited by examiner

CABLE MOUNTING MEMBER, CABLE MOUNTING MEMBER WITH CABLE AND CONNECTOR

BACKGROUND

Field of the Invention

The invention relates to a cable mounting member.

Description of the Related Art

Japanese Unexamined Patent Publication No. 2012-155892 describes a crimping terminal to be crimped to a cable that includes a core and an insulation coating surrounding the core. This crimping terminal includes a first standing portion of an overlap type and a second standing portion of a non-overlap type. The first and second standing portions are crimped respectively to the insulation coating of the cable.

A pulling force may act on the cable having the crimping terminal crimped thereto and may cause the insulation coating to elongate and slip relative to the core inside. However, a cable holding force by the crimping terminal of Japanese Unexamined Patent Publication No. 2012-155892 may be reduced if the insulation coating slips relative to the core.

The cable mounting member described in this specification was completed based on the above situation and aims to assure a sufficient cable holding force.

SUMMARY

A cable mounting member in accordance with this specification is to be mounted on a cable that includes a core and an insulation coating surrounding the core. The cable mounting member includes a first holding portion held in contact with an outer peripheral surface of the insulation coating, a second holding portion spaced from the first holding portion along an axial direction of the cable via a first slit held in contact with the outer peripheral surface of the insulation coating, and a deflectable and deformable first coupling in a part between the first and second holding portions where the first slit is absent and coupling the first and second holding portions.

According to this configuration, the first and second holding portions hold the cable by being held in contact with the outer peripheral surface of the insulation coating at different positions in the direction along the axial direction of the cable. A pulling force on the cable causes the first coupling to deflect and deform so that the cable between the first and second holding portions can bend locally. This causes a frictional force between the core and the insulation coating to increase at a position where the cable is bent and makes the insulation coating difficult to slip relative to the core. Thus, a cable holding force by the cable mounting member remains high.

A terminal that is crimped to the cable with a strong force to restrict slippage of the insulation coating relative to the core may change an impedance of the cable and may affect transmission performance. However, the cable of this disclosure is bent locally and can be held even if the terminal is not crimped to the cable with a strong force. Thus, the deterioration of transmission performance due to an impedance change of the cable can be suppressed.

The cable mounting member may further have a third holding portion spaced from the first and second holding portions along the axial direction of the cable via a second slit for holding the cable by contacting the outer peripheral surface of the insulation coating. A deflectable and deformable second coupling may be in a part between the second and third holding portions where the second slit is absent and may couple the second and third holding portions. The second coupling is offset from the first coupling in a circumferential direction of the cable. With this arrangement, a force to pull the cable will deflect the first and second couplings so that the cable can bend locally at plural positions. Thus, the insulation coating is less likely to slip relative to the core, and a reduction of a cable holding force by the cable mounting member is suppressed further.

The cable mounting member may further include two barrel pieces that define the first holding portion, the second holding portion and the first coupling. The barrel pieces include an overlap in which a tip side of one barrel piece overlaps on a tip side of the other barrel piece, and the first coupling may be provided in the overlap. With this arrangement, the strength of the first coupling is enhanced by a thickness of the overlap so that the width of the first coupling can be reduced and the first coupling can be made flexible while enhancing the strength thereof.

The cable may be an unshielded twist pair cable (hereafter a UTP cable) including a twisted pair cable as the core and the insulation coating collectively surrounding the twisted pair cable. The UTP cable has no shield layer. Thus, friction between the twisted pair cable and the insulation coating is small as compared to an STP cable or the like having a shield layer, and the UTP cable has a property that the insulation coating easily slips relative to the twisted pair cable. Thus, a frictional force between the twisted pair cable and the insulation coating can be increased by locally bending the UTP cable having such a property. Thus, the insulation coating becomes less likely to slip relative to the core and a reduction of the cable holding force by the cable mounting member can be suppressed.

A cable mounting member with cable includes the above-described cable mounting member and the cable having the cable mounting member mounted thereon.

A housing may be provided to accommodate the cable mounting member. The cable mounting member may include a locked portion, and the housing may include a locking portion that engages the locked portion to restrict movement of the cable mounting member. Thus, a force generated on the cable can be received by the housing and will not affect a connected part to a mating terminal or the like.

DETAILED DESCRIPTION

Figure 17:
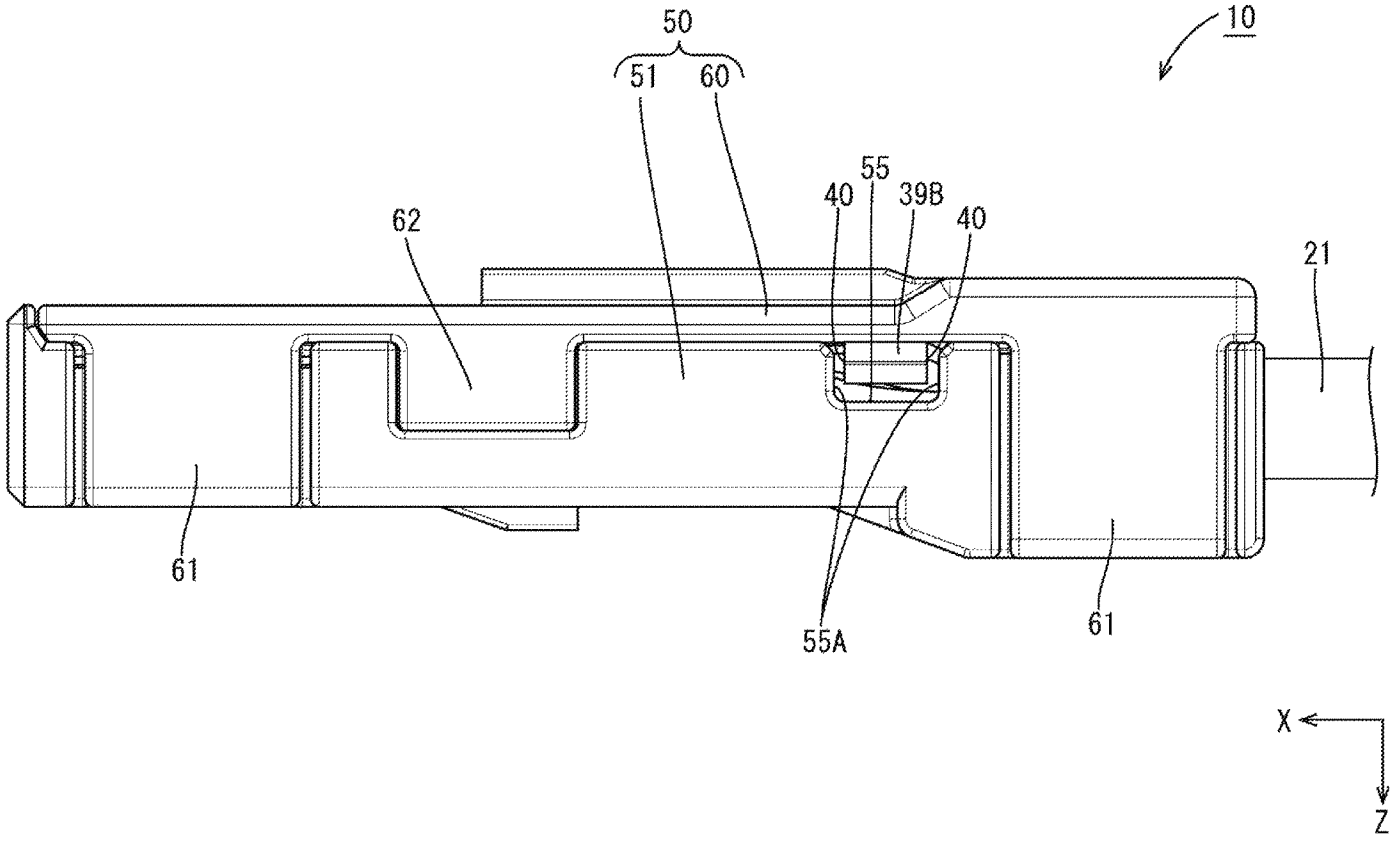
FIG. 17 is a side view showing the cable mounting member with cable.

A first embodiment is described with reference to FIGS. 1 to 19. A connector 10 (FIG. 17) of this embodiment is installed in a vehicle such as an electric or hybrid vehicle and can be disposed in a wired communication path between an in-vehicle electric component (car navigation system, ETC (Electronic Toll Collection System), monitor or the like) in the vehicle and an external device (camera or the like) or between in-vehicle electric components. The connector 10 can be arranged in an arbitrary orientation, but the following description is made with an X direction as a forward direction, a Y direction as a rightward direction and a Z direction as an upward direction.

(Connector 10)

Figure 9:
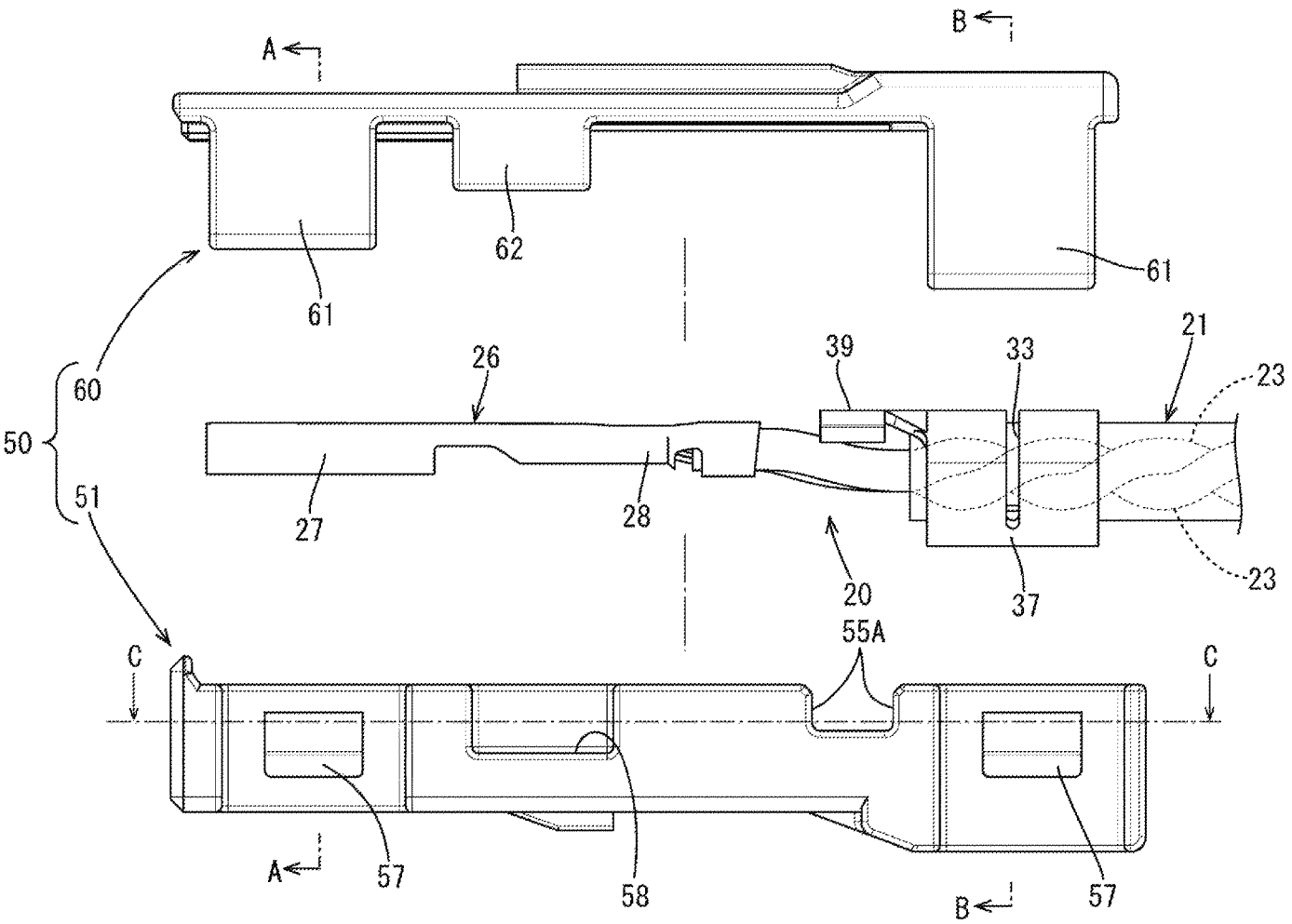
FIG. 9 is a side view showing an exploded state of a connector.
Figure 10:
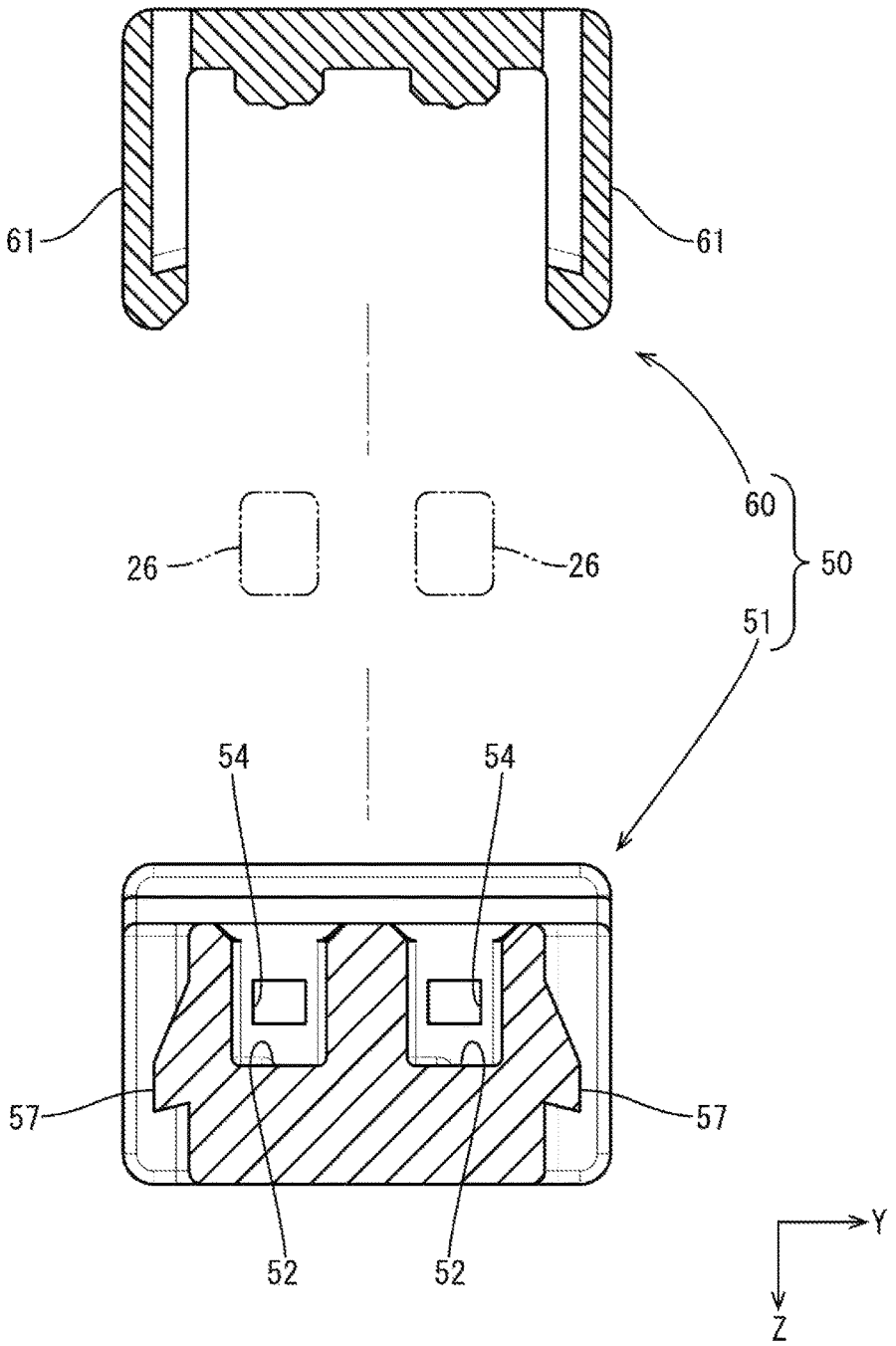
FIG. 10 is a section along A-A of FIG. 9.
Figure 11:
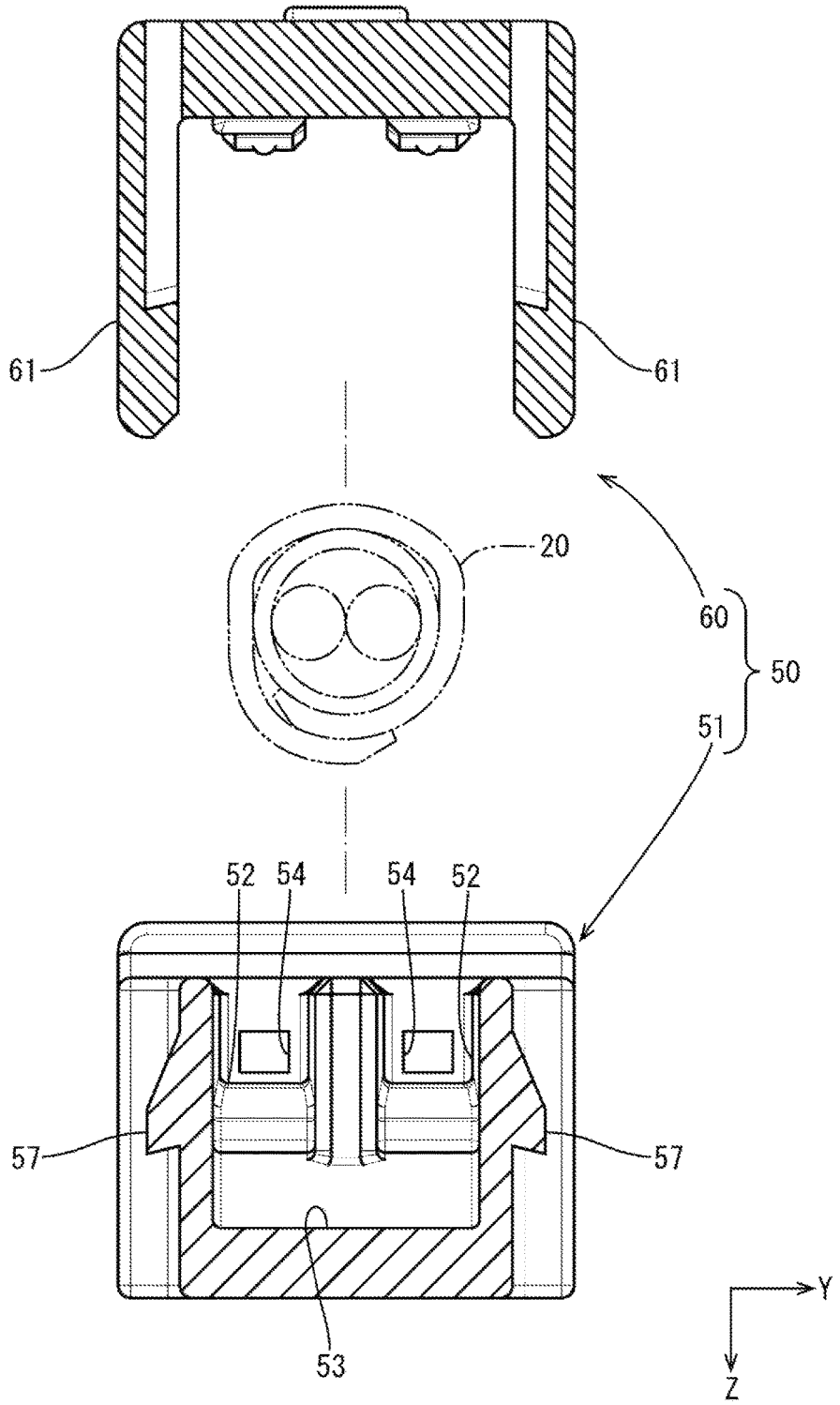
FIG. 11 is a section along B-B of FIG. 9.

As shown in FIG. 9, the connector 10 includes a cable mounting member with cable 20 formed by mounting a cable mounting member 30 on a cable 21, and a housing 50 for accommodating the cable mounting member 30.

(Cable Mounting Member with Cable 20)

Figure 1:
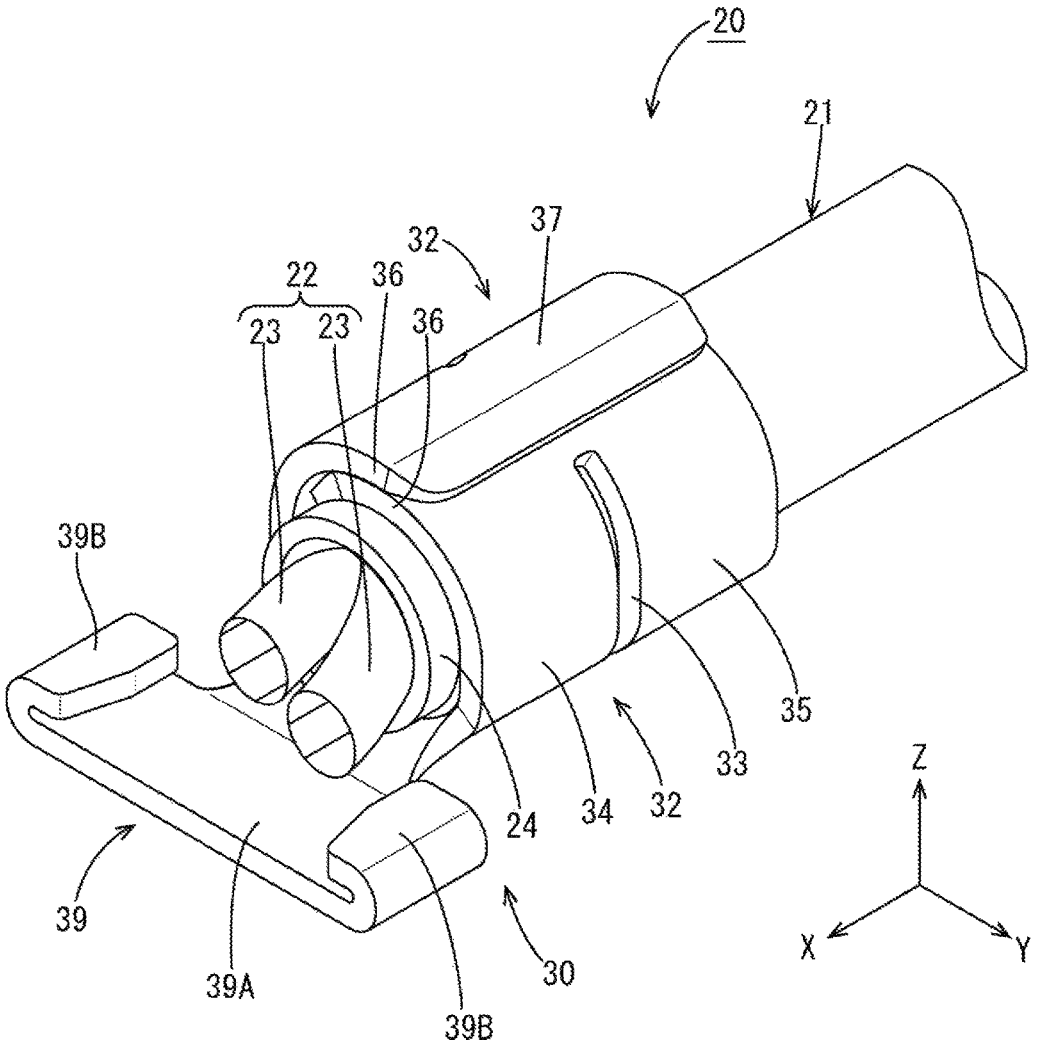
FIG. 1 is a perspective view of a cable mounting member with cable of a first embodiment.

As shown in FIG. 1, the cable mounting member with cable 20 includes the cable 21 and the cable mounting member 30 mounted on the end part of the cable 21.

(Cable 21)

The cable 21 is a UTP cable (Unshielded Twist Pair cable) with a twisted pair cable 22 and an insulation coating 24 collectively surrounding the twisted pair cable 22. No shield layer is provided between the twisted pair cable 22 and the insulation coating 24.

The twisted pair cable 22 is constituted by twisting two cores 23, each of which has a metal conductor covered by an insulating layer. The end part of the cable 21 has the insulation coating 24 removed to expose the cores 23, and end parts of the exposed cores 23 have the insulating layers removed to expose the conductor parts to be connected to terminals 26. As shown in FIG. 9, the terminal 26 is, for example, an integrally formed female terminal with a terminal connecting portion 27 on a front end and a cable connecting portion 28 on a rear end. The terminal connecting portion 27 is a rectangular tube, and a resilient contact piece is provided inside for contacting a mating male terminal. The cable connecting portion 28 is crimped to the conductor part exposed from the core 23. Note that an insulating filling member made of threads, paper tape or the like may be provided to fill up the clearance between the twisted pair cable 22 and the insulation coating 24.

(Cable Mounting Member 30)

Figure 5:
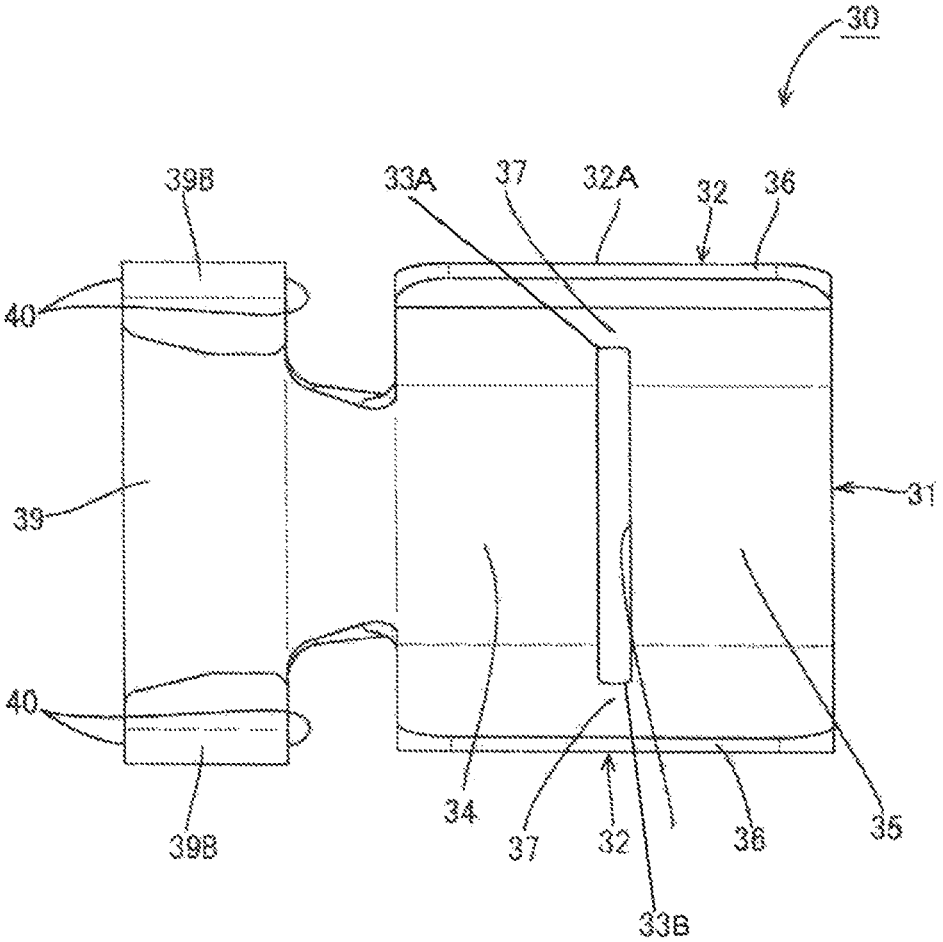
FIG. 5 is a plan view showing a cable mounting member.
Figure 6:
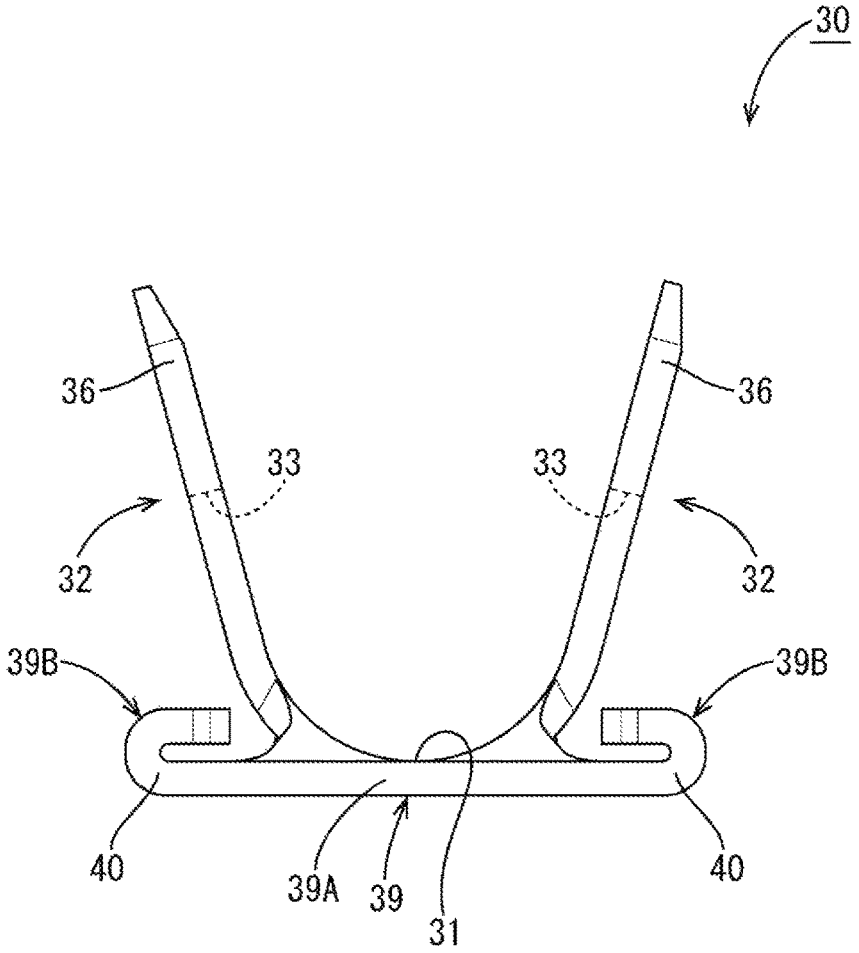
FIG. 6 is a front view showing the cable mounting member.
Figure 7:
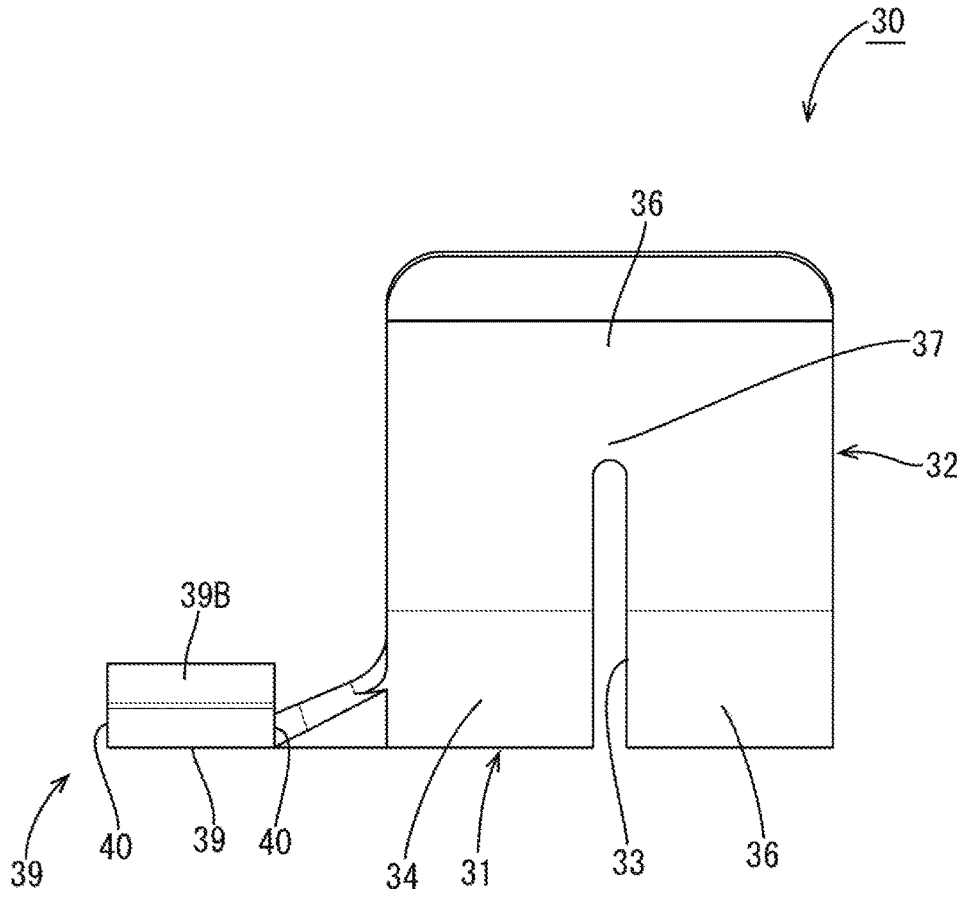
FIG. 7 is a side view of the cable mounting member.
Figure 8:
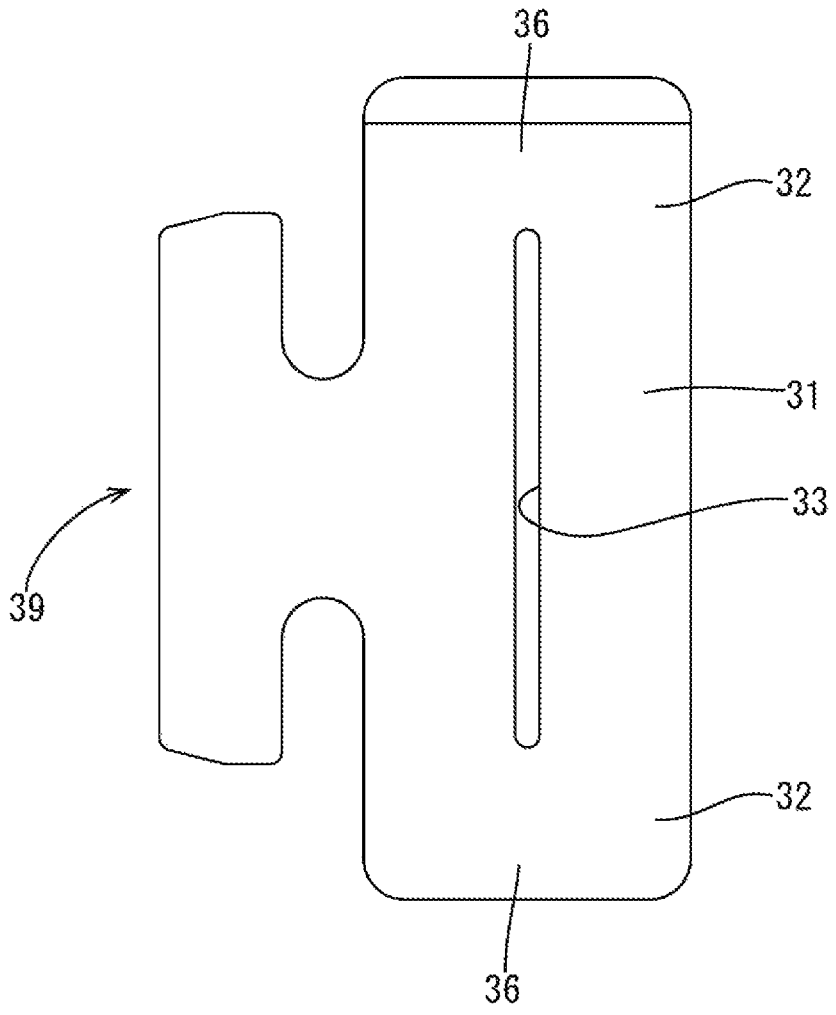
FIG. 8 is a development of the cable mounting member.

As shown in FIGS. 5 and 6, the cable mounting member 30 includes a bottom plate 31 on which the cable 21 is to be placed, two barrel pieces 32 standing up from both sides of the bottom plate 31 and an extending portion 39 extending forward of the bottom plate 31. The two barrel pieces 32 each having an upper edge 32A spaced from the bottom plate 31. The bottom plate 31 is curved so that an intermediate part is lower. A first slit 33 extending in a lateral direction (along a circumferential direction of the cable 21) between first and second slit ends 33A, 33B and is formed in intermediate parts of the bottom plate 31 and the barrel pieces 32 in a front-rear direction. Tip parts of the barrel pieces 32 are inclined toward the tips to reduce a thickness.

The bottom plate 31 and the barrel pieces 32 include a first holding portion 34 for holding the cable 21 by being held in contact with the outer peripheral surface of the insulation coating 24 of the cable 21 and a second holding portion 35 for holding the cable 21 by being held in contact with the outer peripheral surface of the insulation coating 24 of the cable 21 at a position different from the first holding portion 34 in a direction along an axial direction (X axis direction) of the cable 21. Further, the barrel pieces 32 include deflectable and deformable first couplings 37 coupling the first and second holding portions 34, 35.

Figure 2:
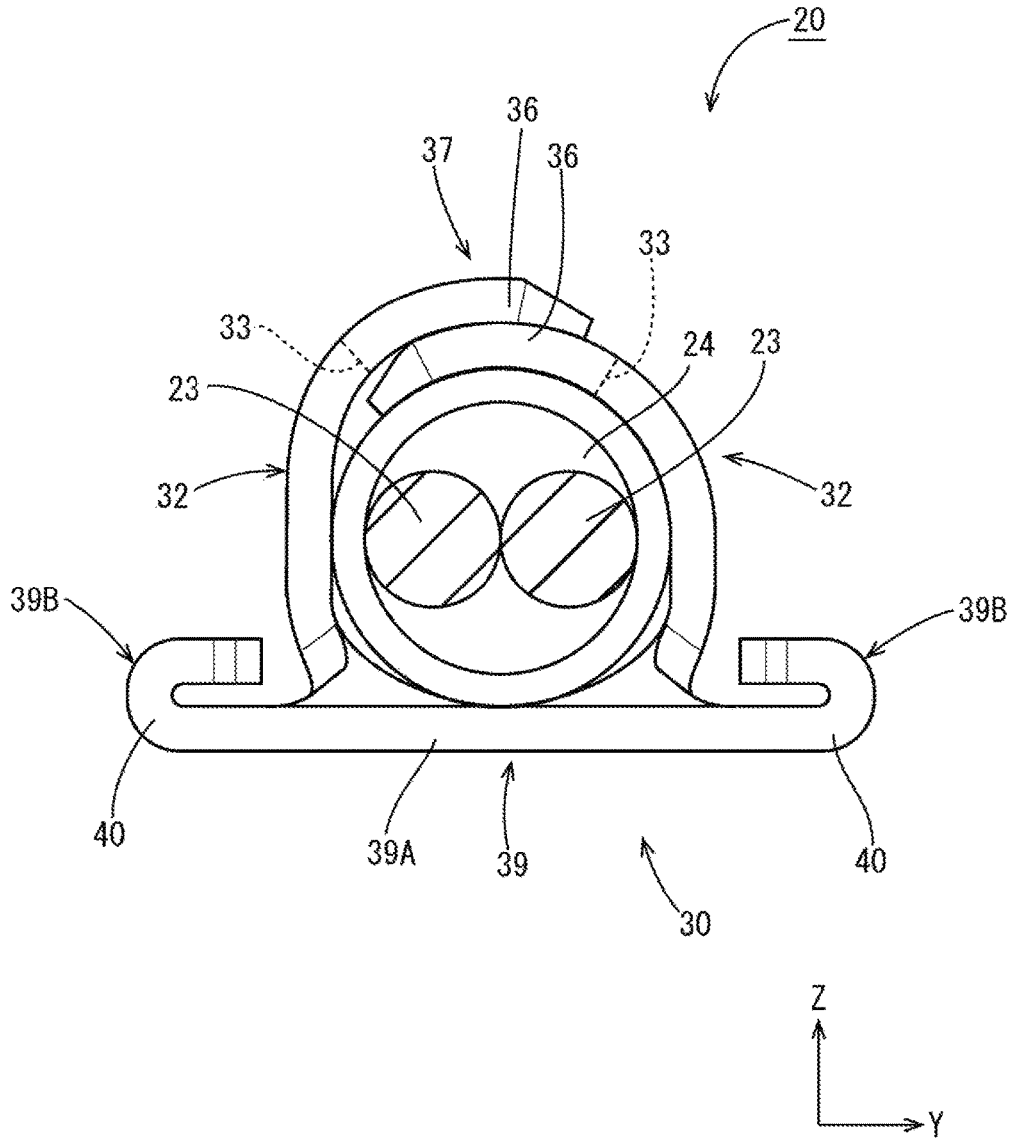
FIG. 2 is a front view showing the cable mounting member with cable.

The first slit 33 is formed between the first and second holding portions 34, 35. The first couplings 37 are provided on sides of the respective barrel pieces 32 closer to the tips than the first slit 33. As shown in FIG. 2, the tip sides of the respective barrel pieces 32 define overlap portions 36 to be overlapped with each other when the insulation coating 24 is fastened by crimping. The overlap portions 36 (first couplings 37) are formed in parts of the tubular entire periphery of the bottom plate 31 and the barrel pieces 32 surrounding the cable 21 where the first slit 33 is not provided, and formed at an opposite position (angle of 180°) to the extending portion 39 in the circumferential direction of the cable 21. Thus, the first couplings 37 are formed in the overlap portions 36. The first couplings 37 have resilient forces to be deflected and deformed when a force F1 (see FIG. 4) to pull the cable 21 is generated.

The extending portion 39 includes a flat plate 39A connected to a front end part of the bottom plate 31 and extending in the lateral direction, and folded portions 39B folded at both end edge parts of the flat plate 39A. Front and rear ends of the folded portions 39B define locked portions 40 to be locked by locking portions 55A of the housing 50 and have an R shape.

(Housing 50)

Figure 12:
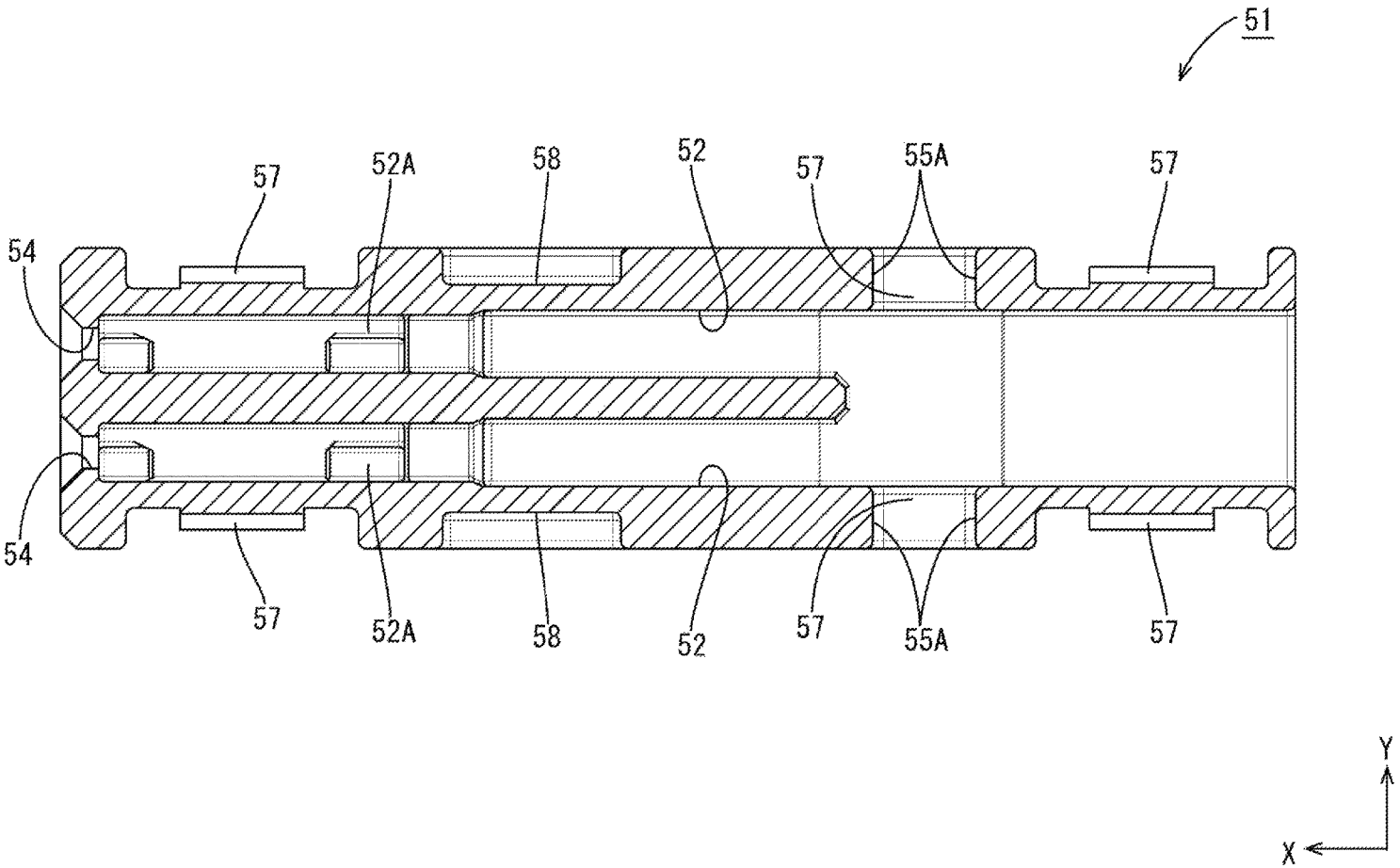
FIG. 12 is a section along C-C of FIG. 9.
Figure 13:
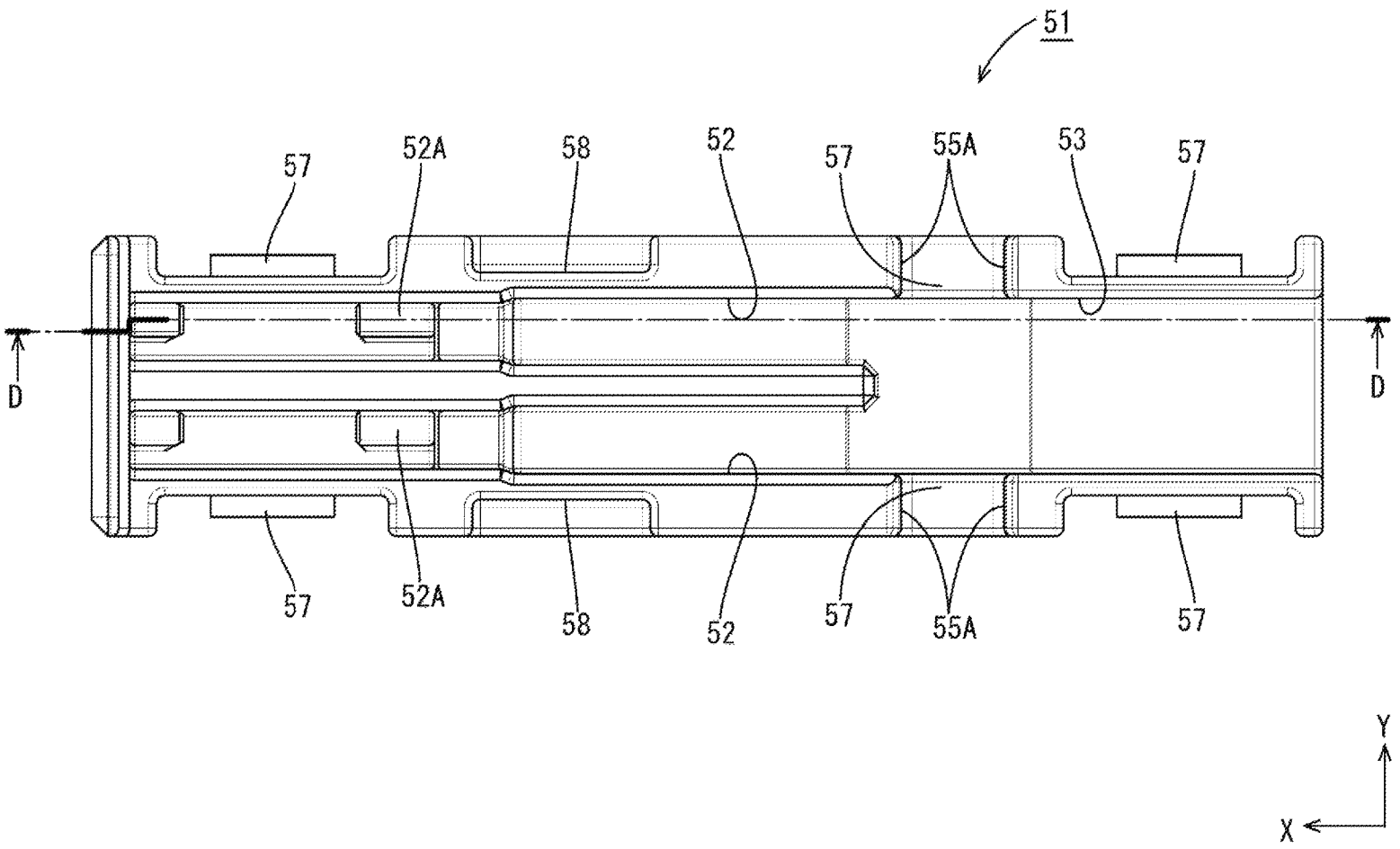
FIG. 13 is a bottom view showing a body.
Figure 14:
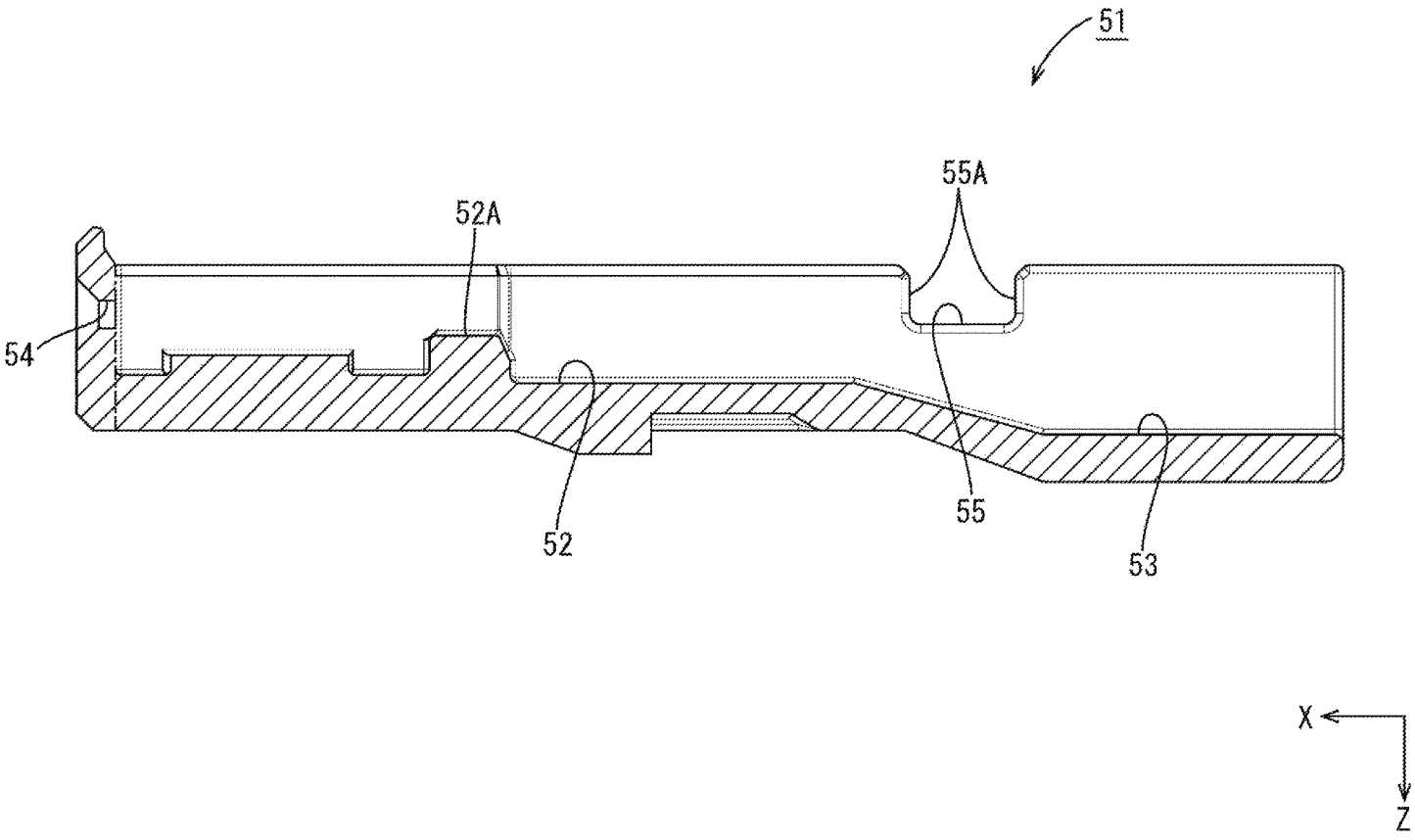
FIG. 14 is a section along D-D of FIG. 13.
Figure 15:
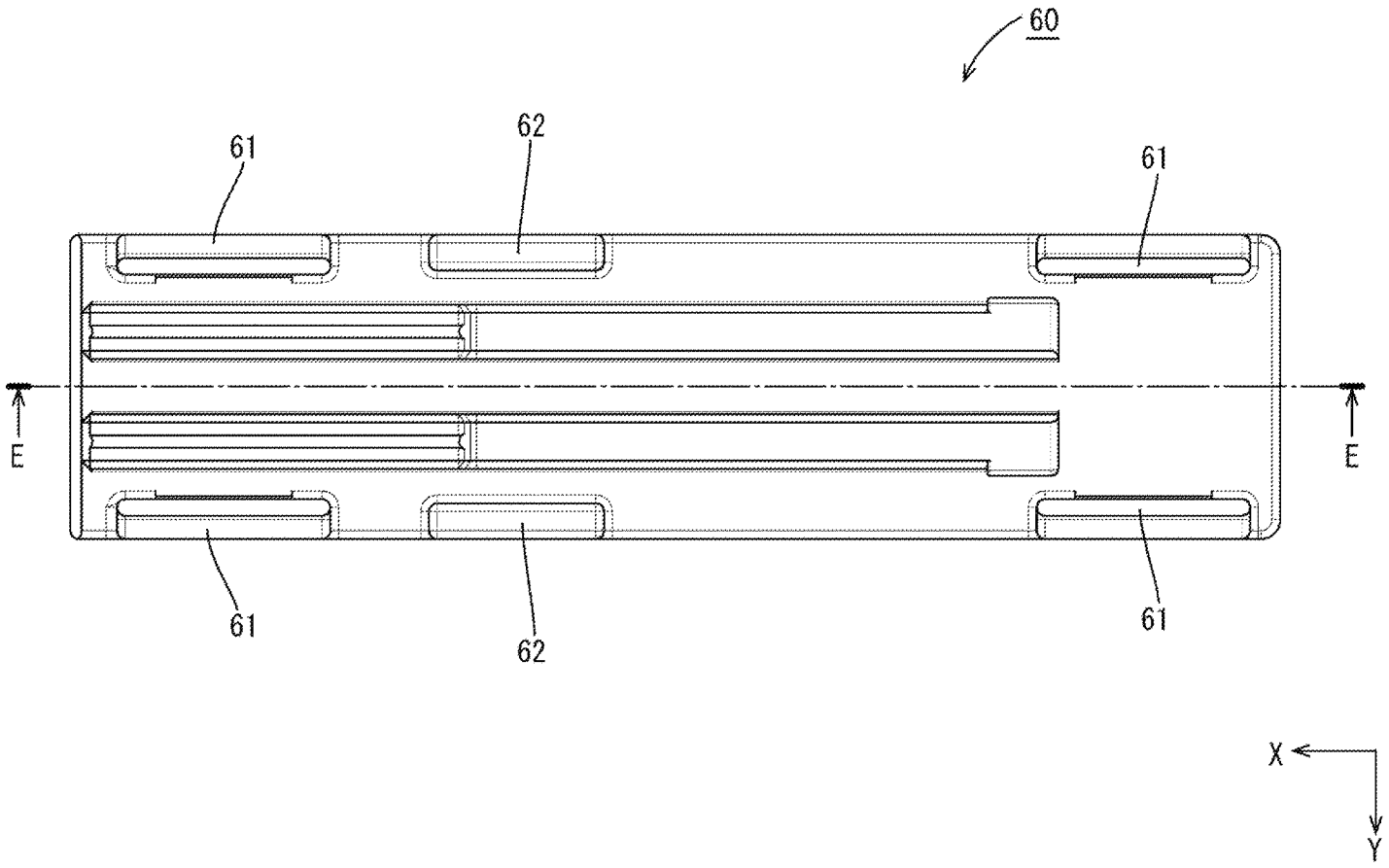
FIG. 15 is a plan view showing a cover.
Figure 16:
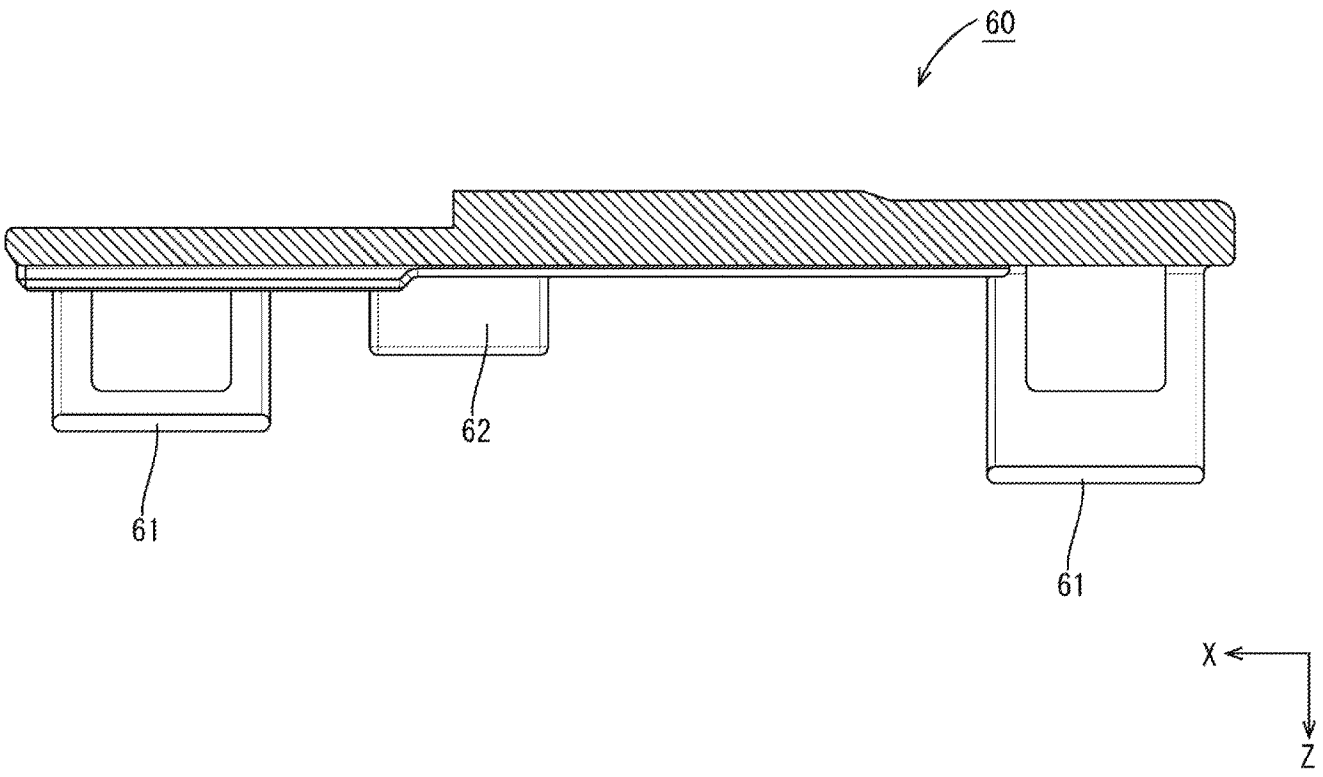
FIG. 16 is a section along E-E of FIG. 15.

The housing 50 is made of insulating synthetic resin and includes a body 51 and a cover 60 for covering an open side of the body 51, as shown in FIG. 9. The body 51 has two terminal accommodating chambers 52 for accommodating two terminals 26 and a mounting member accommodating chamber 53 behind the terminal accommodating chambers 52 for accommodating the cable mounting member 30, as shown in FIG. 12. Retaining protrusions 52A are formed on the bottom walls of the terminal accommodating chambers 52 for retaining the terminals 26, and the terminals 26 are held between the front walls of the terminal accommodating chambers 52 and the retaining protrusions 52A. Terminal insertion holes 54 penetrate the front walls of the terminal accommodating chambers 52 and enable insertion of the mating male terminals.

Side walls of the body 51 have rectangular cutouts 55 that receive the folded portions 39B of the cable mounting member 30. Front and rear end parts of each cutout 55 define the locking portions 55A for restricting a movement of the cable mounting member 30 in the front-rear direction by locking the locking portions 40. Engaged protrusions 57 and a guide recess 58 are formed on the outer surface of each of the side walls of the body 51. The cover 60 is a rectangular plate and includes engaging claws 61 for holding the cover 60 in a closed state by engaging the engaged protrusions 57 and a plate-like guide projection 62 to be inserted and guided in the guide recess 58 on side edges thereof. Each engaging claw 61 has a deflectable and deformable plate with an inwardly projecting a claw that is locked to a step of the engaged protrusion 57.

Figure 18:
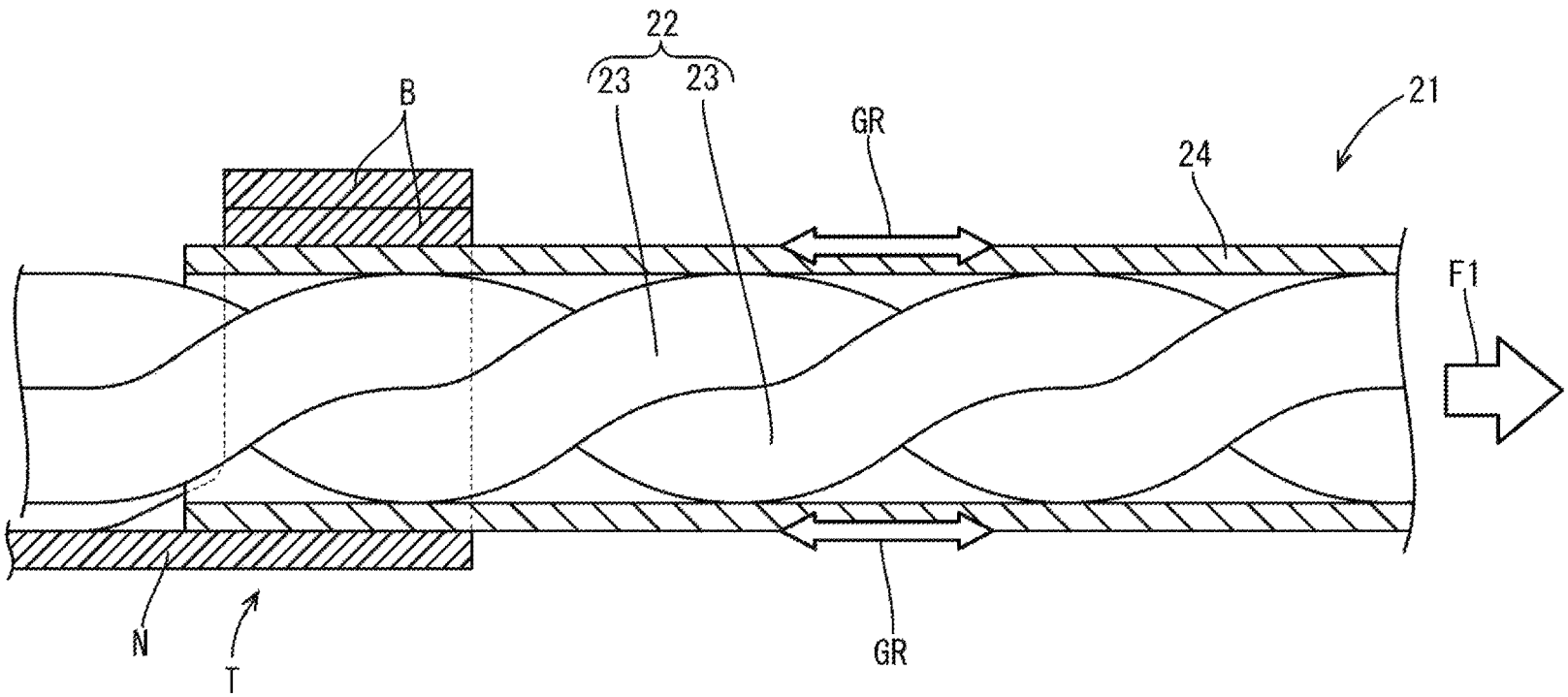
FIG. 18 is a diagram showing the slip of an insulation coating relative to a core as a comparative example.

FIG. 18 shows a cable mounting member T with two barrel pieces B, but no first slit. The barrel pieces B are crimped to the insulation coating 24 of the cable 21. A force F1 due to the vibration of the vehicle, or the like, may pull the cable 21 and may cause the insulation coating 24 to elongate GR so that the insulation coating 24 slips relative to the twisted pair cable 22 inside. If the insulation coating 24 slips relative to the twisted pair cable 22, a holding force of the barrel pieces B to hold this insulation coating 24 may be reduced.

Figure 19:
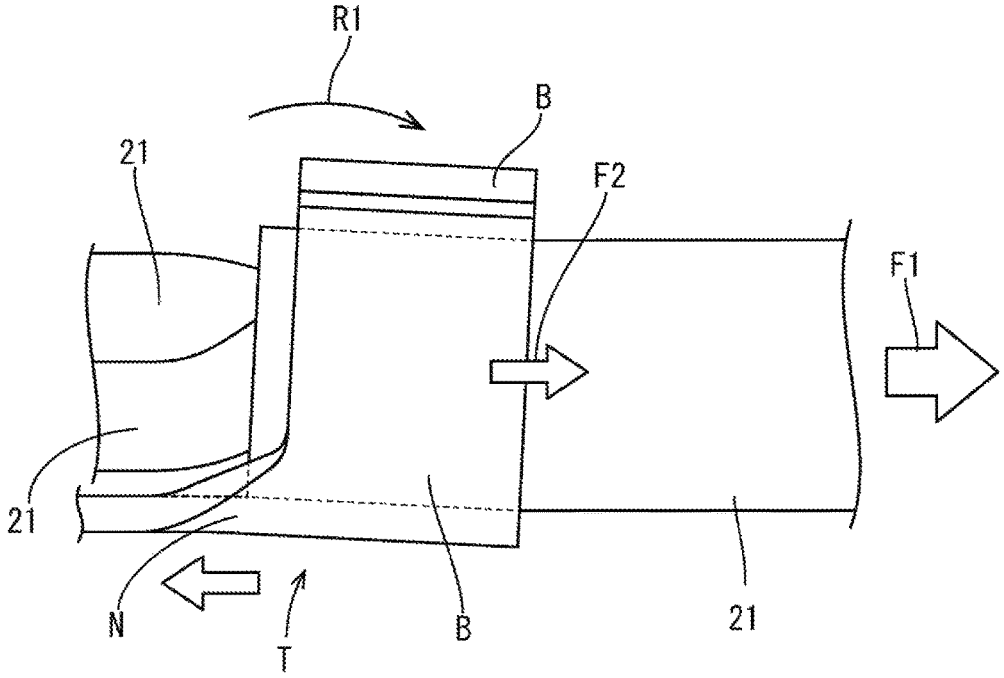
FIG. 19 is a diagram showing the inclination of the cable mounting member as a comparative example.

On the other hand, FIG. 19 shows a configuration in which the barrel pieces of the cable mounting member T are crimped to the insulation coating 24 of the cable 21. A force F2 to pull the cable mounting member T rearward due to the force F1 to pull the cable 21 acts on a central side, whereas a neck N extending forward of the cable mounting member T is locked to a housing or the like and, hence, the cable mounting member T is inclined in a direction of an arrow R1 of FIG. 19 with the neck portion N as a starting point. The cable mounting member 30 of this embodiment utilizes the inclination of the cable mounting member caused by the force F1 to pull the cable 21.

Specifically, the cable mounting member 30 of this embodiment is mounted on the cable 21 including the cores 23 and the insulation coating 24 surrounding the cores 23, and includes the first holding portion 34 for holding the cable 21 by being held in contact with the outer peripheral surface of the insulation coating 24, the second holding portion 35 provided at the position different from the first holding portion in the direction along the axial direction of the cable 21 via the first slit 33 for holding the cable 21 by being held in contact with the outer peripheral surface of the insulation coating 24, and the deflectable and deformable first couplings 37 provided in the parts between the first and second holding portions 34, 35 where the first slit 33 is absent and coupling the first and second holding portions 34, 35.

Figure 3:
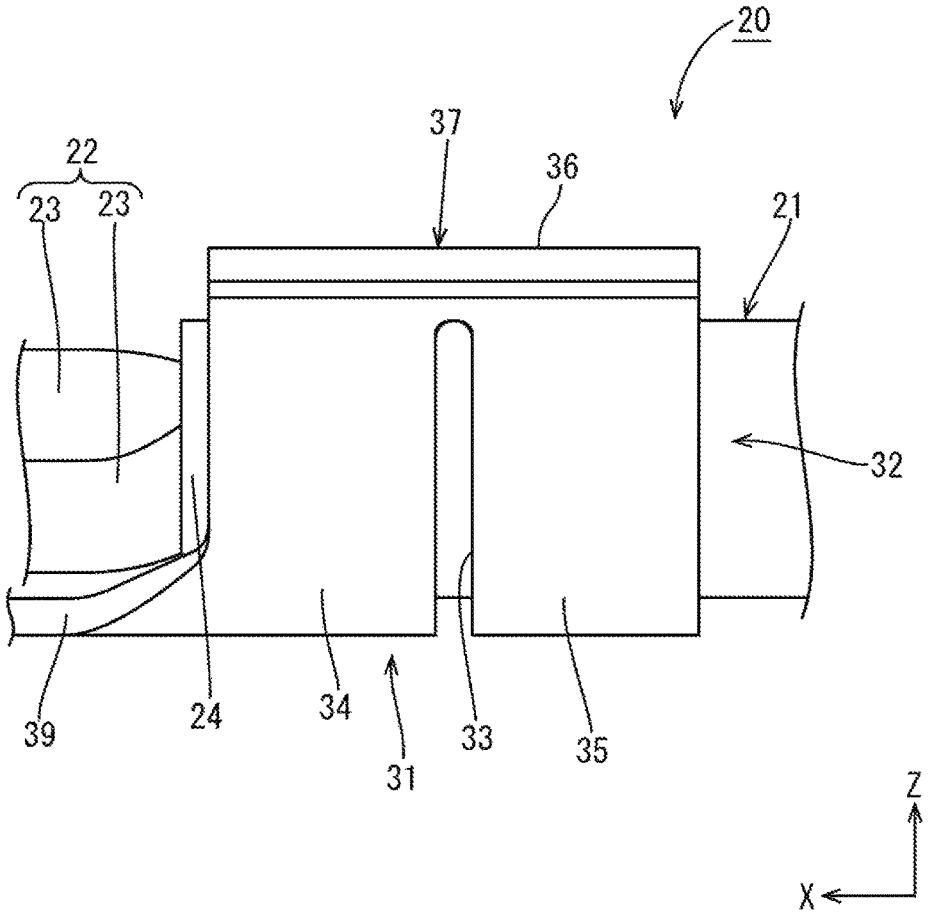
FIG. 3 is a side view showing the cable mounting member with cable.
Figure 4:
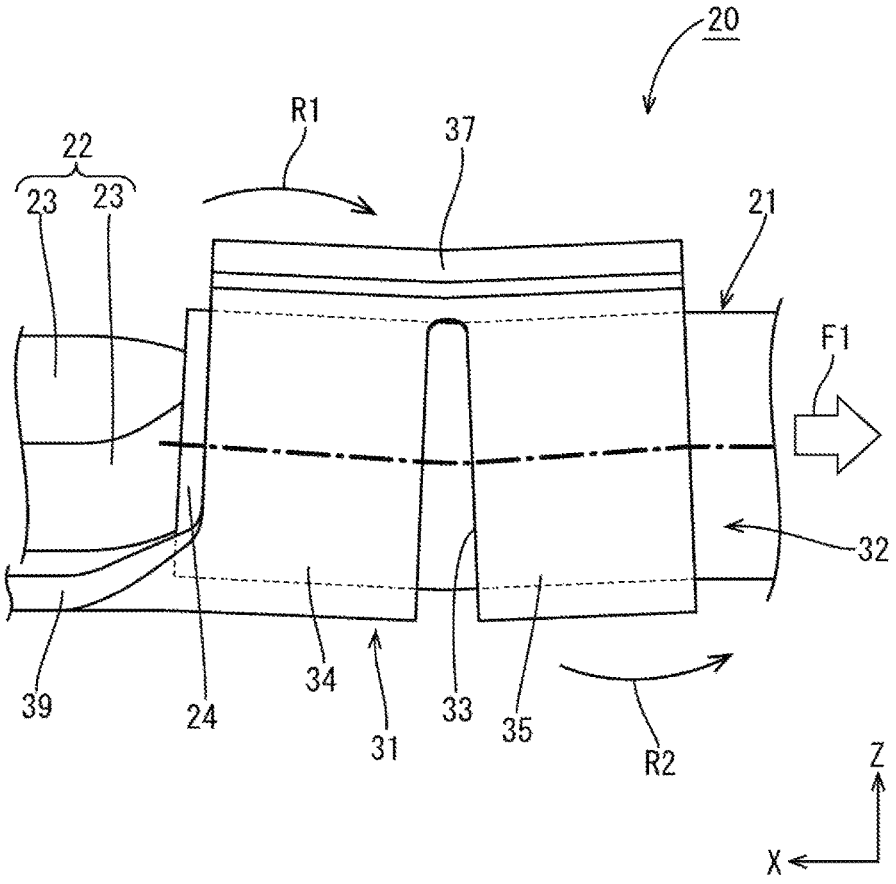
FIG. 4 is a side view showing the cable mounting member with cable when a force to pull a cable is generated.

As shown in FIG. 3, the first and second holding portions 34, 35 hold the cable 21 by being held in contact with the outer peripheral surface of the insulation coating 24 at different positions in the direction along the axial direction of the cable 21. A force to pull the cable 21 causes the first couplings 37 coupling the first and second holding portions 34, 35 to deflect and deform, as shown in FIG. 4. Thus, the cable 21 is bent locally between the first and second holding portions 34, 35 (at the position of the first slit 33) without changing a direction of the cable 21 outside the cable mounting member 30. This causes a frictional force between the cores 23 and the insulation coating 24 to increase at the position where the cable 21 is bent and makes the insulation coating 24 difficult to slip relative to the cores 23, thereby suppressing a reduction of the holding force of the cable mounting member 30 on the cable 21.

Further, if the terminals 26 are crimped to the cable 21 with a strong force to restrict the slip of the insulation coating 24 relative to the cores 23, an impedance of the cable 21 may change to affect transmission performance. However, according to this embodiment, the cable 21 can be held even if the terminals 26 are not crimped to the cable 21 with a strong force, and deterioration of transmission performance due to an impedance change of the cable 21 can be suppressed.

The cable mounting member 30 includes the two barrel pieces 32 having the first holding portion 34, the second holding portion 35 and the first couplings 37. The barrel pieces 32 include the overlaps 36 where the tip side of one barrel piece 32 is overlapped with the tip side of the other barrel piece 32, and the first couplings 37 are provided in the overlaps 36. With this arrangement, the strength of the first couplings 37 is enhanced by the thicknesses of the overlaps 36 so that the widths of the first coupling portions 37 can be reduced and the first couplings 37 can be easily made flexible while enhancing the strength thereof.

Further, the cable 21 is the UTP cable including the twisted pair cable 22 as the cores 23 and the insulation coating 24 collectively surrounding the twisted pair cable 22. The UTP cable has no shield layer. Thus, friction between the twisted pair cable 22 and the insulation coating 24 is small as compared to a STP cable (Shielded twist Pair cable) having a shield layer, and the UTP cable has a property that the insulation coating 24 easily slips relative to the twisted pair cable 22. According to the above configuration, a frictional force between the twisted pair cable 22 and the insulation coating 24 can be increased by locally bending the cable 21. Thus, the insulation coating 24 becomes less likely to slip relative to the cores 23 and a reduction of the holding force to hold the cable 21 by the cable mounting member 30 can be suppressed.

Further, the housing 50 accommodates the cable mounting member 30. The cable mounting member 30 includes the locked portions 40, and the housing 50 includes the locking portions 55A for restricting a movement of the cable mounting member 30 by locking the locked portions 40. With this arrangement, a force generated on the cable 21 can be received by the housing 50. Thus, the force generated on the cable 21 can be prevented from affecting connected parts to the mating terminals or the like.

A second embodiment is described with reference to FIGS. 20 and 21. The barrel pieces 32 are of an overlap type with overlap portions 36 as in the first embodiment. However, the configuration of the tip sides of the barrel pieces 32 is changed in the second embodiment. The same components as in the first embodiment are denoted by the same reference signs and not described.

Figure 20:
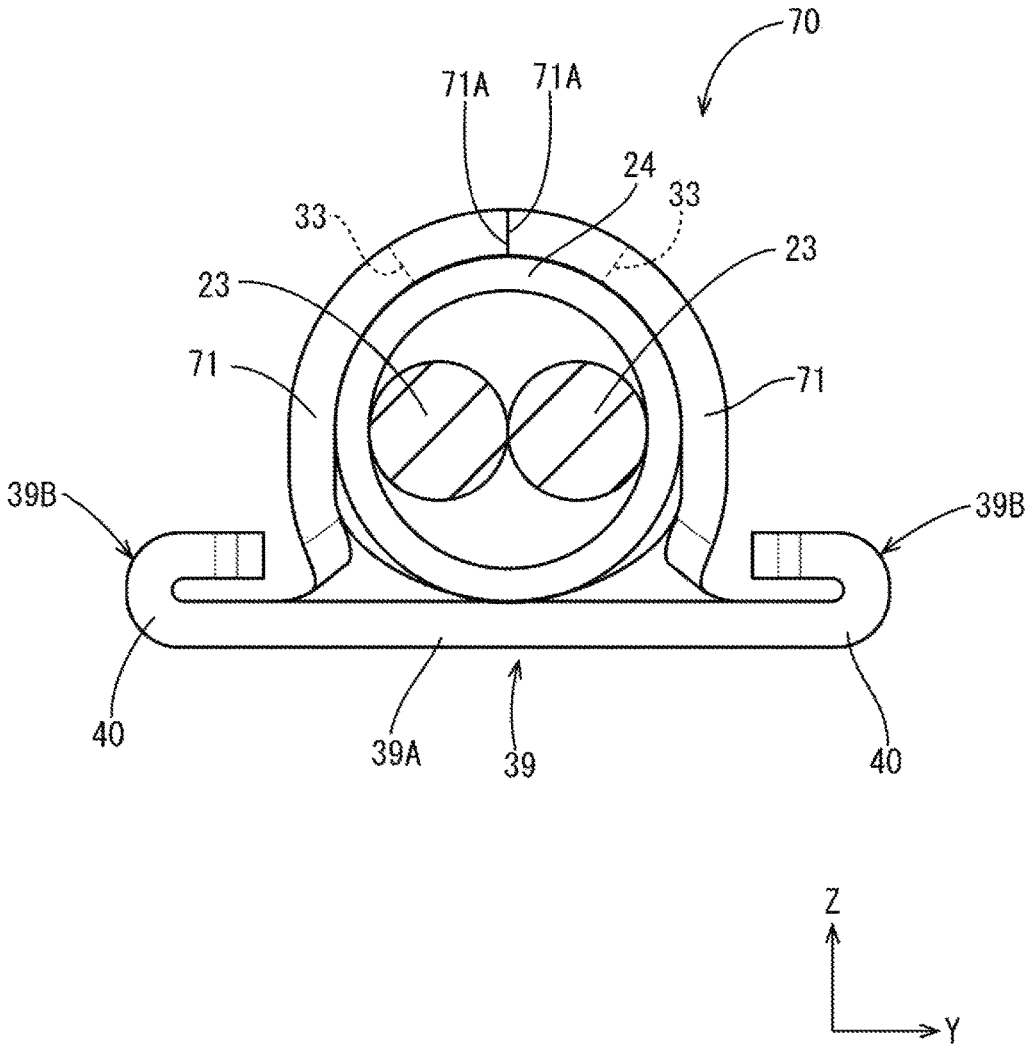
FIG. 20 is a front view showing a cable mounting member with cable of a second embodiment.
Figure 21:
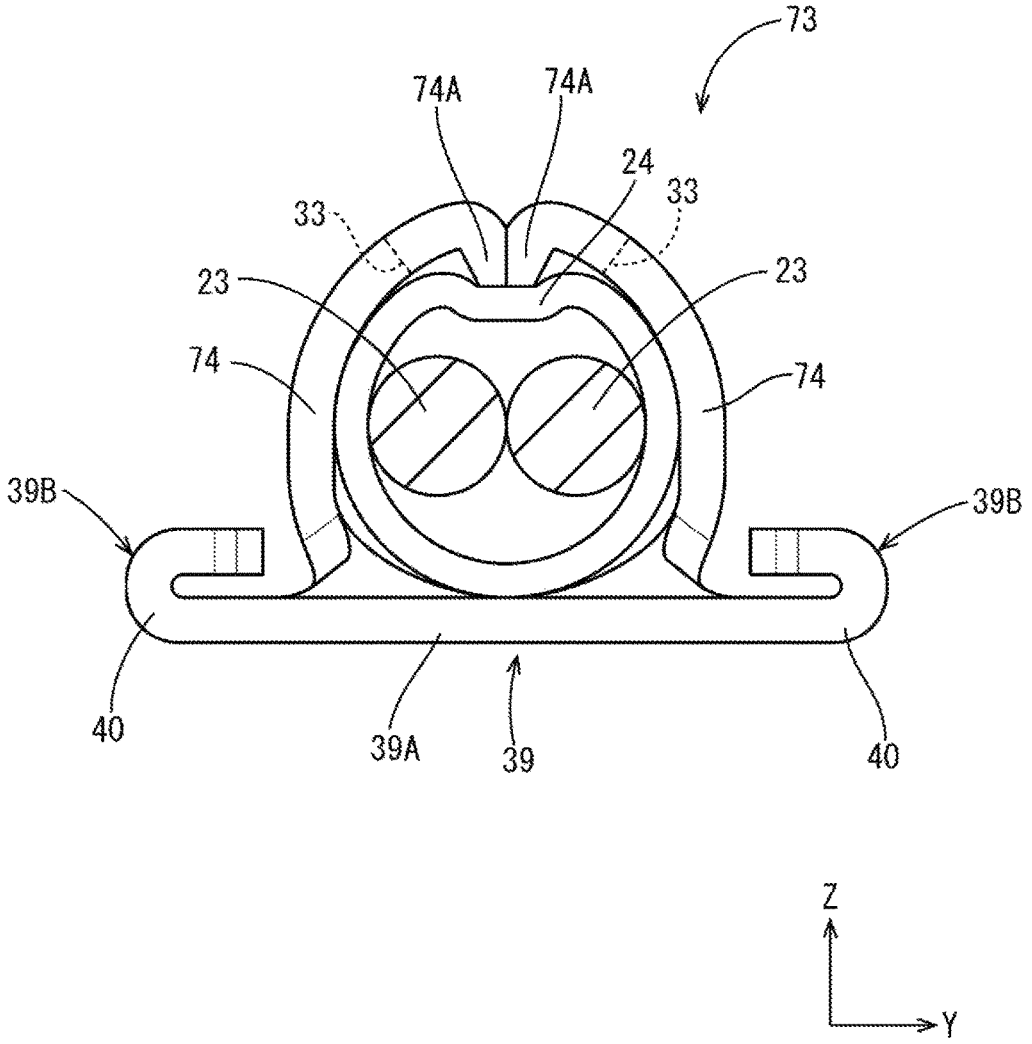
FIG. 21 is a front view showing a cable mounting member with cable different from that of FIG. 20.
Figure 22:
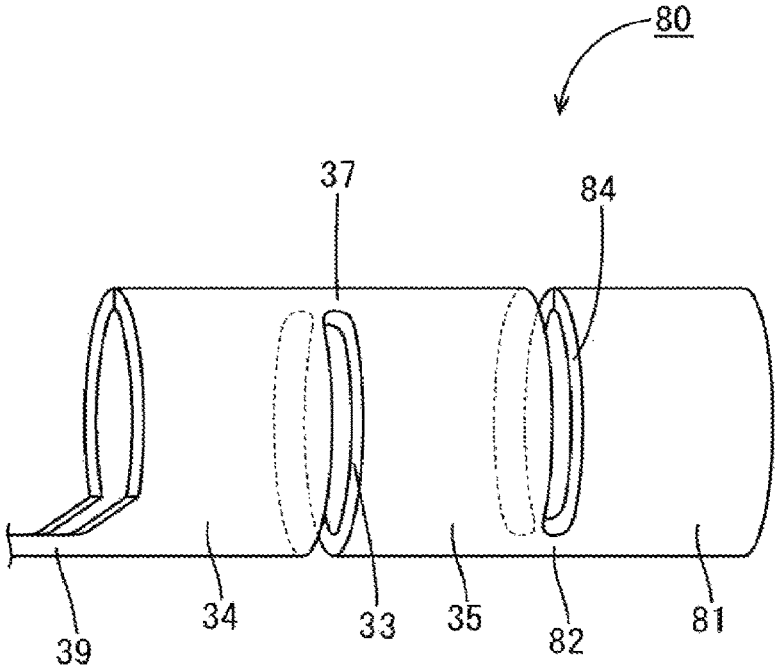
FIG. 22 is a perspective view showing a cable mounting member of a third embodiment.
Figure 23:
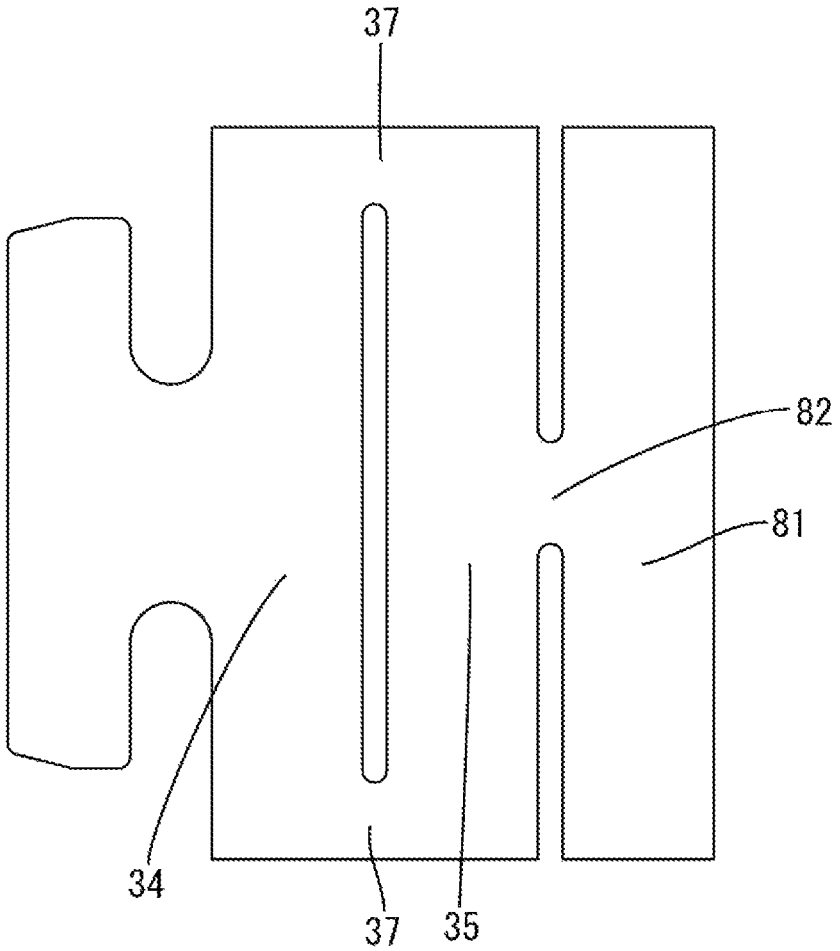
FIG. 23 is a development of the cable mounting member of FIG. 22.

Front ends 71A, 71A of a barrel pieces 71 of a cable mounting member 70 mounted on an end part of a cable 21 butt against each other (O-crimp), as shown in FIG. 20. Note that, without being limited to this, two barrel pieces 74 of a cable mounting member 73 may be caulked such that front end parts 74A, 74A thereof bite into an insulation coating 24 while butting against each other (F-crimp) as shown in FIG. 21.

A third embodiment is described with reference to FIGS. 22 to 26. In the following description, the same components as in the above embodiments are denoted by the same reference signs and not described.

A bottom plate portion and a pair of barrel pieces of a cable mounting member 80 of the third embodiment include a first holding portion 34 for holding a cable 21 by being held in contact with the outer peripheral surface of an insulation coating 24 of the cable 21, a second holding portion 35 for holding the cable 21 by being held in contact with the outer peripheral surface of the insulation coating 24 of the cable 21 at a position different from the first holding portion 34 in a direction along an axial direction of the cable 21, and a third holding portion 81 for holding the cable 21 by being held in contact with the outer peripheral surface of the insulation coating 24 of the cable 21 at a position different from the first and second holding portions 34, 35 in the direction along the axial direction of the cable 21. Further, the barrel pieces include a deflectable and deformable first coupling 37 coupling the first and second holding portions 34, 35 and a deflectable and deformable second coupling 82 coupling the second and third holding portions 35, 81.

A first slit 33 and a second slit 84 are formed between the first and second holding portions 34, 35 and between the second and third holding portions 35, 81. The second coupling 82 is formed at an opposite position (position at an angle of 180°) to the first coupling portion 37 in a circumferential direction. Specifically, the second coupling 82 is formed at the same position (angle) as an extending portion 39 in the circumferential direction.

Figure 24:
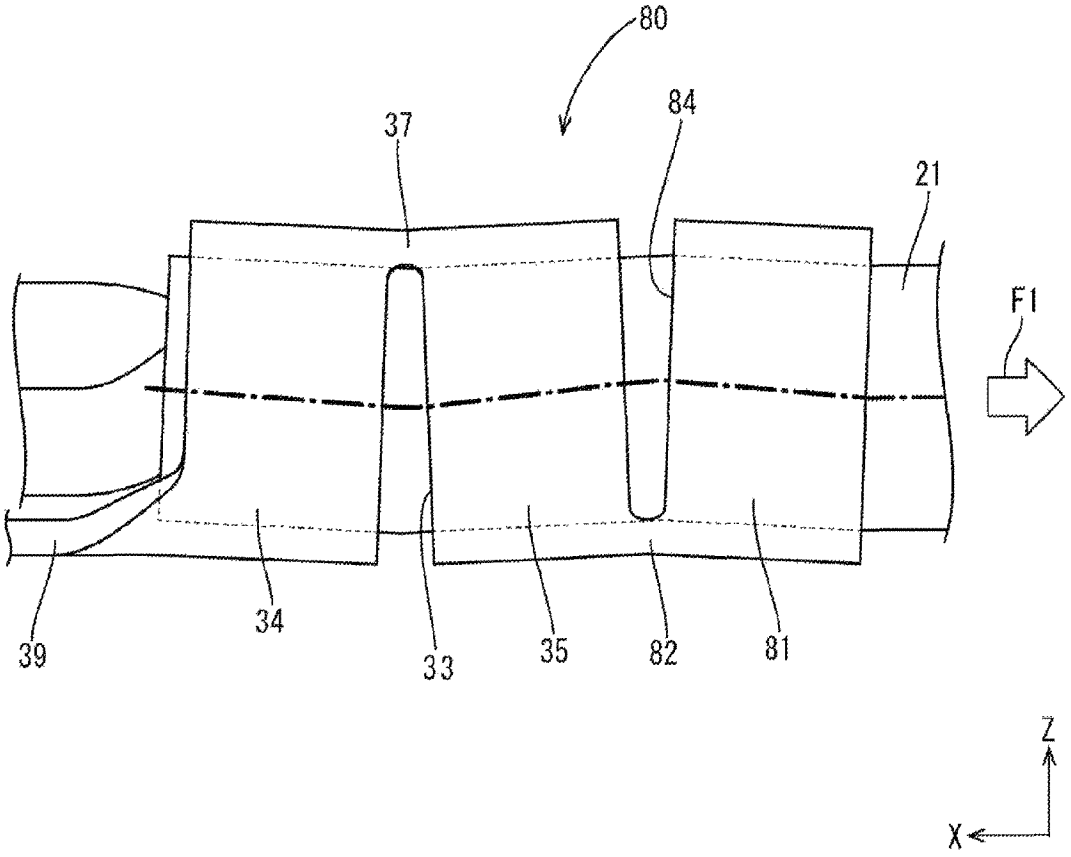
FIG. 24 is a side view showing a cable mounting member with cable when a force to pull a cable is generated.

According to the third embodiment, the cable mounting member 80 includes the third holding portion 81 provided at the position different from the first and second holding portions 34, 35 in the direction along the axial direction of the cable 21 via the second slit 84 for holding the cable 21 by being held in contact with the outer peripheral surface of the insulation coating 24 and the deflectable and deformable second coupling portion 82 provided in a part between the second and third holding portions 35, 81 where the second slit 84 is absent and coupling the second and third holding portions 35, 81, and the second coupling portion 82 is provided at the position different from the first coupling portion 37 in the circumferential direction of the cable 21. With this arrangement, if a force F1 in a direction to pull the cable 21 is generated, the first and second coupling portions 37, 82 are deflected as shown in FIG. 24, whereby the cable 21 can be locally bent at a plurality of positions (positions of the slits 33, 84). Thus, the insulation coating 24 becomes less likely to slip relative to the cores 23 and a reduction of a holding force to hole the cable 21 can be further suppressed.

Figure 25:
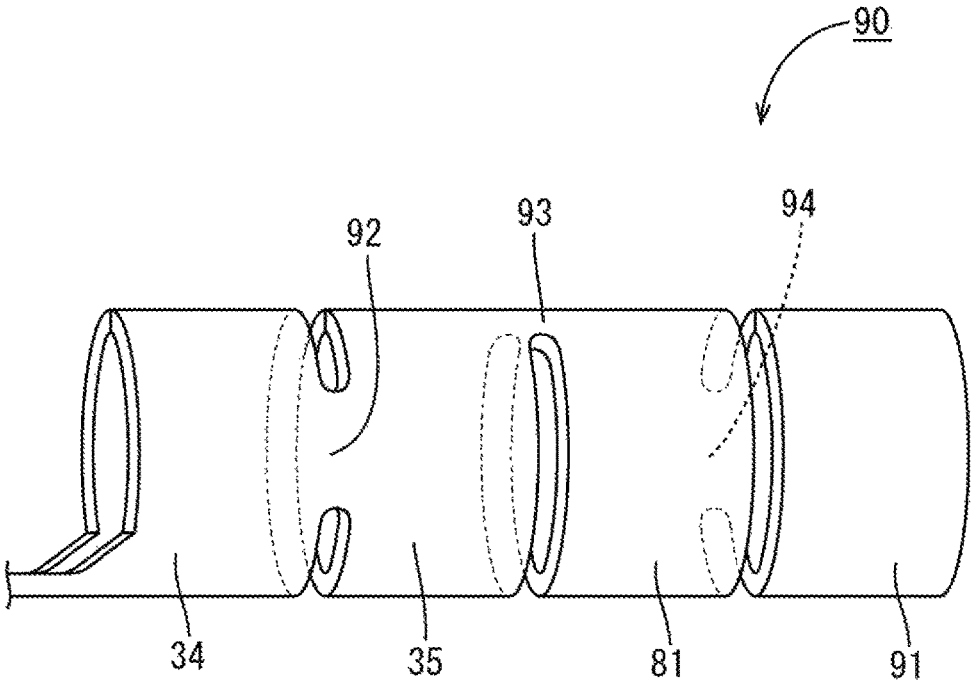
FIG. 25 is a perspective view showing a cable mounting member different from that of FIG. 22.
Figure 26:
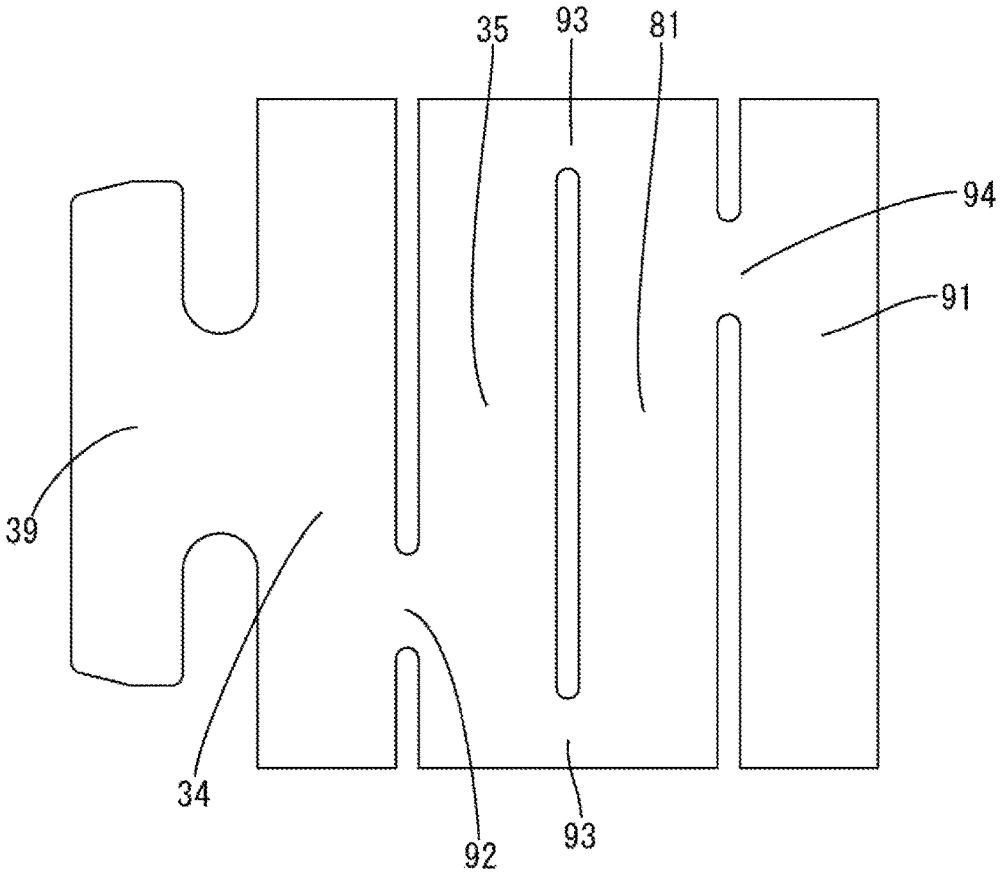
FIG. 26 is a development of the cable mounting member of FIG. 25.

Note that, without being limited to this, a bottom plate and two barrel pieces of a cable mounting member 90 may include a first holding portion 34, a second holding portion 35, a third holding portion 81 and a fourth holding portion 91, the barrel pieces may include a deflectable and deformable first coupling 92 coupling the first and second holding portions 34, 35, a deflectable and deformable second coupling 93 coupling the second and third holding portions 35, 81, and a deflectable and deformable third coupling 94 coupling the third and fourth holding portions 81, 91 as shown in FIGS. 25 and 26. In this case, the first, second and third couplings 37, 82 and 94 are formed at positions (angles) shifted by 90° in the circumferential direction of the cable 21. Note that, without being limited to this, the first, second and third couplings 37, 82 and 94 may be formed at mutually different angles other than 90°.

The invention is not limited to the above described and illustrated embodiments. For example, the following embodiments also are included in the scope of the invention.

The cable mounting member 30 may be formed into a terminal. The cable mounting member may be a female terminal with a box-shaped terminal connecting portion to be connected to a mating male terminal, and the cable mounting member may be integral to the terminals 26.

Although the cable mounting member 30 is of an open barrel type including the bottom plate portion 31 and the two barrel pieces 32, there is no limitation to this. For example, the cable mounting member may be of a closed barrel type to be caulked and crimped to the cable 21 inserted into a hollow cylindrical tubular portion.

Edges configured to bite into the insulation coating 24 may be provided on inner surfaces of the barrel pieces 32.

The cable 21 is not limited to the UTP cable. For example, the cable 21 may be a STP cable or a cable other than those for communication.

LIST OF REFERENCE SIGNS

10: connector
20: cable mounting member with cable
21: cable
22: twisted pair cable
23: core
24: insulation coating
30, 70, 73, 80, 90: cable mounting member
31: bottom plate
32: barrel piece
33: first slit
34: first holding portion
35: second holding portion
36: overlap
37, 92: first coupling
39: extending portion
40: locked portion
50: housing
51: body
55A: locking portion
81: third holding portion
82, 93: second coupling
84: second slit
91: fourth holding portion
94: third coupling

What is claimed is:

1. A cable mounting member to be mounted on a cable including a core and an insulation coating surrounding the core, the cable mounting member comprising:

a bottom plate extending in a forward and backward direction;

first and second barrel pieces projecting from opposite sides of the bottom plate, each of the first and second barrel pieces having an upper edge spaced from the base bottom plate;

a continuous slit formed in the bottom plate and the first and second barrel pieces, the slit having a first end formed on the first barrel piece at a position between the upper edge of the first barrel piece and the bottom plate, and a second end formed on the second barrel piece at a position between the upper edge of the second barrel piece and the bottom plate, the slit extending in a direction substantially normal to the forward and backward direction and defining a first holding portion formed by portions of the first and second barrel pieces and the bottom plate forward of the slit and a second holding portion formed by portions of the first and second barrel pieces and the bottom plate rearward of the slit; and first and second deflectable and deformable coupling portions formed respectively on the first and second barrel pieces and coupling the first and second holding portions to each other, the first coupling portion extending in the forward and backward direction between the upper edge of the first barrel piece and the first end of the slit, and the second coupling portion extending in the forward and backward direction between the upper edge of the second barrel piece and the second end of the slit.

2. The cable mounting member of claim 1, further comprising:

a second slit formed rearward of the second holding portion;

a third holding portion provided rearward of the second slit; and at least one deflectable and deformable additional coupling coupling the second holding portion to the third holding portion, wherein:

the at least one additional coupling is provided at a position different from the first and second couplings in a circumferential direction of the cable.

3. The cable mounting member of claim 1, wherein:

the first and second barrel pieces include an overlap in which a tip side of one of the first and second barrel pieces overlaps on a tip side of the other of the first and second barrel pieces, and the first and second couplings are provided in the overlap portion.

4. The cable mounting member of claim 1, wherein the cable is a UTP cable including a twisted pair cable as the core and the insulation coating collectively surrounding the twisted pair cable.

5. A connector, comprising a housing for accommodating the cable mounting member of claim 1, wherein:

the cable mounting member includes a locked portion; and the housing includes a locking portion at a position corresponding to the locked portion when the cable mounting member is accommodate in the housing, the locking portion engaging the locked portion to restrict a movement of the cable mounting member by locking the locked portion.

6. A cable mounting member to be mounted on a cable including a core and an insulation coating surrounding the core, the cable mounting member comprising:

a bottom plate extending in a forward and backward direction;

first and second barrel pieces projecting from opposite side edges of the bottom plate, each of the first and second barrel pieces having an upper edge spaced from the bottom plate;

a continuous first slit formed in the bottom plate and the first and second barrel pieces, the first slit having a first end formed on the first barrel piece at a position between the upper edge of the first barrel piece and the bottom plate, and a second end formed on the second barrel piece at a position between the upper edge of the second barrel piece and the bottom plate, the first slit extending in a direction substantially normal to the forward and backward direction and defining a first holding portion formed by portions of the first and second barrel pieces and the bottom plate forward of the first slit and a second holding portion formed by portions of the first and second barrel pieces and the bottom plate rearward of the first slit; and areas of the first and second barrel pieces between the first slit and the upper ends of the first and second barrel pieces forming a pair of second slits rearward of the second holding portions, each of the pair of second slits having an end portion formed in the bottom plate at positions aligned with each other in the forward and backward direction, each of the pair of second slits extending normal to the forward and backward direction and in directions opposite each other from the end portions thereof to the upper edge of one of the first and second barrel pieces, the pair of second slits defining a third holding portion rearward of the pair of second slits;

a pair of first deflectable and deformable coupling portions formed respectively on the first and second barrel pieces and coupling the first and second holding portions to each other, the first coupling extending in the forward and backward direction between the upper edge of the first barrel piece and the first end of the first slit, and the second coupling extending in the forward and backward direction between the upper edge of the second barrel piece and the second end of the first slit; and a second deflectable and deformable coupling portion formed between the pair of second slits, the second coupling portion provided at a position different from the pair of first coupling portions in a circumferential direction of the cable.

7. A connector, comprising:

a cable mounting member to be mounted on a cable including a core and an insulation coating surrounding the core, the cable mounting member comprising:

a first holding portion for holding the cable by being held in contact with an outer peripheral surface of the insulation coating;

a second holding portion provided at a position different from the first holding portion in a direction along an axial direction of the cable via a slit for holding the cable by being held in contact with the outer peripheral surface of the insulation coating;

a deflectable and deformable first coupling provided in a part between the first and second holding portions where the slit is absent and coupling the first and second holding portions; and a locking portion; and a housing for accommodating the cable mounting member, the housing including a locked portion at a position corresponding to the locking portion when the cable mounting member is accommodated in the housing, the locking portion engaging the locked portion to restrict a movement of the cable mounting member by locking the locked portion.

* * * * *